United States Patent [19]

Sluyterman et al.

[11] Patent Number: 4,612,525

[45] Date of Patent: Sep. 16, 1986

[54] METHOD OF MANUFACTURING A SADDLE-SHAPED DEFLECTION COIL FOR A PICTURE DISPLAY TUBE AND DEFLECTION SYSTEM HAVING SADDLE-SHAPED DEFLECTION COILS

[75] Inventors: Albertus A. S. Sluyterman; Nicolaas G. Vink, both of Eindhoven, Netherlands

[73] Assignee: U.S. Philips Corporation, New York, N.Y.

[21] Appl. No.: 714,604

[22] Filed: Mar. 21, 1985

[30] Foreign Application Priority Data

Mar. 21, 1984 [NL] Netherlands ..... 8400886

[51] Int. Cl.[4] ..... H01F 5/00

[52] U.S. Cl. ..... 335/213; 324/426; 242/7.11

[58] Field of Search ..... 335/210, 212, 213; 313/421, 426, 428; 242/7.07, 7.09, 7.11

[56] References Cited

U.S. PATENT DOCUMENTS

| | | | |
|---|---|---|---|
| 4,039,989 | 8/1977 | Staal et al. | 335/213 |
| 4,143,346 | 3/1979 | Borkar et al. | 335/213 |
| 4,464,643 | 8/1984 | Meershoek | 335/213 |

*Primary Examiner*—George Harris

*Attorney, Agent, or Firm*—Thomas A. Briody; Jack Oisher; William J. Streeter

[57] ABSTRACT

During winding, the turns of the coil (9) are distributed over a number of sections (27, 29, 31) in which between each pair of adjacent sections an aperture (23, 25) is formed by providing, after winding the first section of the pair, pins (37, 38, 41) in the winding space around which the second section is wound. For the formation of at least one of the apertures (23) pins (38, 39) are provided in the winding space in at least two places on the same side of the plane of symmetry (43) of the coil so that said aperture obtains approximately the shape of a polygon having four or more sides.

6 Claims, 3 Drawing Figures

Figure 1:
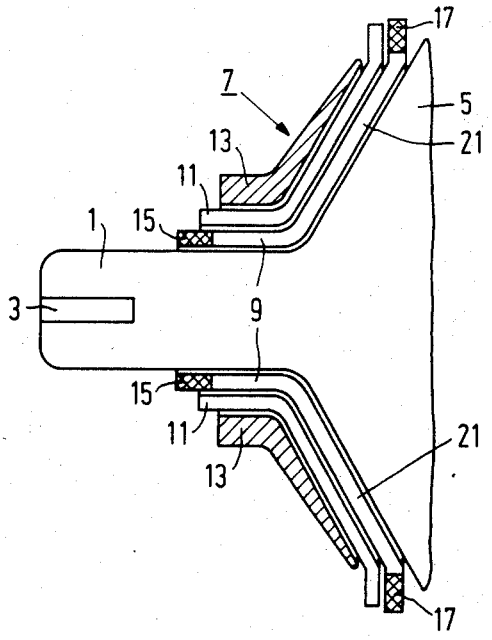

METHOD OF MANUFACTURING A SADDLE-SHAPED DEFLECTION COIL FOR A PICTURE DISPLAY TUBE AND DEFLECTION SYSTEM HAVING SADDLE-SHAPED DEFLECTION COILS

The invention relates to a method of continuously winding saddle-shaped flared deflection coils for picture display tubes, said coils being wider at their front side than at their rear side, in which the turns of the coil are distributed over a number of sections and in which each turn of a section surrounds the turns of the preceding sections and each pair of adjacent sections is separated over a part of its length by at least one aperture which is formed in that in at least one previously determined place along the boundary between the two sections after providing the number of turns desired for the first of the said two sections a pin extending approximately at right angles to the plane of the turns is provided in the winding space, after which the second section is wound around said pins. The invention also relates to a deflection system for a picture display tube comprising at least two saddle-shaped flared deflection coils each having a comparatively narrow rear and a comparatively wide front end portion between which on each side of a window two active parts extend in each of which at least one aperture is present.

Such a method is known from Dutch Patent Specification 158 021. In this method the properties of the coil can be influenced by determining in the design the place of the open spaces and choosing the number of turns per section during winding. This makes it possible in many cases to adapt the distribution of the magnetic flux generated by the coil to the requirements imposed. It has been found, however, that this is not sufficient in all cases, in particular when more refined corrections are to be made.

It is an object of the invention to improve the method of the type mentioned in the opening paragraph in such a manner that the designer of the coil has a greater influence than so far on the distribution of the generated magnetic flux.

For that purpose the method according to the invention is characterized in that for the formation of at least one of the apertures pins are inserted into the winding space substantially simultaneously in at least two places on the same side of the plane of symmetry of the coil. By choosing the place of the two or more pins per aperture, the designer can previously determine exactly not only the place but also the shape of each aperture. As a result of this it is possible to influence the generated magnetic flux very considerably and very exactly.

The invention also relates to a deflection system which comprises two saddle-shaped flared deflection coils each having a comparatively narrow rear and a comparatively wide front end portion between which two active portions extend on each side of a window in each of which at least one aperture is present, said deflection system being characterized in that at least one of the apertures has at least four sides.

It is noted that Dutch Patent Application 7600687 discloses a deflection system having saddle-shaped deflection coils in which the boundary between the window and each of the active parts has a bend so that the window has approximately the shape of a polygon. The apertures present in the active parts in the known device, however, have a triangular shape, and thus have three sides.

Figure 2:
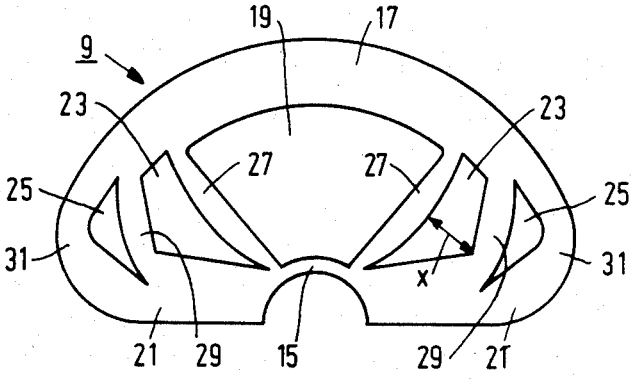
Figure 3:
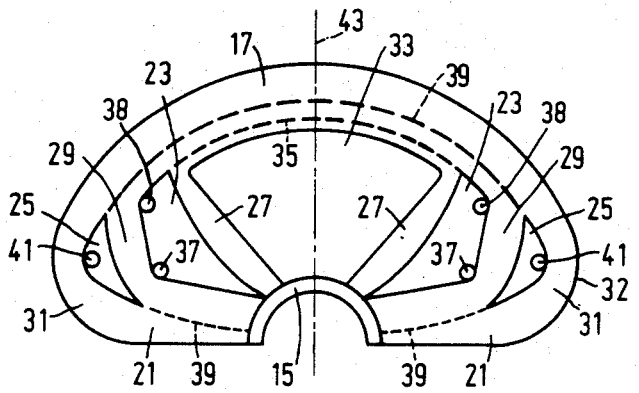

The invention will now be described in greater detail with reference to the drawing, in which:

FIG. 1 is a diagrammatic longitudinal sectional view of a part of a picture display tube having a deflection system according to the invention, FIG. 2 is a front elevation of a line deflection coil of the deflection system shown in FIG. 1 and FIG. 3 is a rear view of the coil shown in FIG. 2 during winding.

The picture display tube shown in FIG. 1 is a colour television display tube having a rear cylindrical portion 1 in which three juxtaposed electron guns 3 are present and a front flared portion 5 in which a colour selection electrode (shadow mask) and a display screen are present (not shown). A deflection system 7 which is present at the area of the transition between the rear portion 1 and the front portion 5 of the tube is placed coaxially with the axis of the tube. The deflection system 7 comprises a set of saddle-shaped line deflection coils 9 for the deflection in the horizontal direction of the electron beams generated by the electron guns 3, a set of saddle-shaped field deflection coils 11 for the deflection in the vertical direction, and a ferro-magnetic annular core 13 surrounding the two sets of coils. Instead of saddle-shaped field deflection coils, field deflection coils wound toroidally around the annular core 13 are also used in many cases.

FIG. 2 is a front elevation of one of the two line deflection coils 9, i.e. viewed from the right in FIG. 1. This coil comprises a number of turns of, for example, copper wire and comprises a rear end portion 15 and a front end portion 17 between which two active portions 21 extend on each side of a window 19. As shown in FIG. 1 the front end portion 17 is bent outwards so that it is farther remote from the electron beams to be deflected. This is not the case with the rear end portion 15. It will be obvious that the bending outwards or not bending outwards of one of the two end portions is a design parameter which has nothing to do with the measure according to the invention. All these possible embodiments are covered by the concept "saddle-shaped deflection coils". The coil 9 is flared so that it is adapted to the conical shape of the part 5 of the picture display tube, its front end portion 17 being wider than its rear end portion 15.

The magnetic flux required for the horizontal deflection of the electron beams is generated substantially entirely in the active portions 21. The flux generated in the end portions 15 and 17 does not contribute substantially to the deflection. Apertures 23, 25 are present in each of the active portions 21. These apertures divide the coil 9 into a number of sections. In the example shown there are three sections, namely an inner section 27, a central section 29 and an outer section 31. Each turn of a section surrounds the turns of the sections more inwardly situated (closer to the window 19). By choosing the number, the place and the shape of the apertures 23, 25, as well as the number of turns in each of the sections 27, 29, 31 the designer can influence the distribution of the magnetic flux generated in the active portions 21 considerably and very accurately. The coil design can be improved by the fact that in addition to apertures having three sides, like the aperture denoted by 25, apertures having four sides, like the aperture denoted by 23, or apertures having an even larger number of sides can be used. This freedom in the choice of the shape of the apertures gives the designer a considerably greater influence on the distribution of the generated magnetic flux.

It is clearly shown in FIG. 2 that the sides of the apertures 23, 25 may be slightly curved so that the shapes do not correspond strictly to a geometrical polygon but only are an approximation thereof. This is caused by the way in which the apertures are produced during winding the coil 9. Said winding will now be described with reference to FIG. 3. This figure is a rear view of the coil shown in FIG. 2 during winding. Said winding is carried out in a winding space which is recessed in a jig which forms part of a winding machine. In order to avoid complexity of the figure, the winding machine and the jig are not shown. The winding space is bounded by walls 32 the shape of which corresponds to the outer boundaries of the coil to be wound.

During winding, the inner section 27 is first wound, for example, about a mandrel 33 which defines the shape of the window 19. As soon as the number of turns required for the section 27 has been reached, pins 37, 38 extending approximately at right angles to the plane of the turns are provided substantially simultaneously in the winding space on the boundary 35 (shown partly in broken lines) between said section and the next section 29. The first turn of the next section 29 is now laid around the pins 37, 38 as a result of which the apertures 23 are formed between the sections 27 and 29 in the active portions 21. After the required number of turns of the second section has been reached, pins 41 extending approximately perpendicularly to the plane of the turns are provided in an analogous manner in the winding space on the boundary 39 (also shown partly in broken lines) between said section and the next one, around which the first turn of the third section is laid. As a result of this the apertures 25 are formed. The parts of the boundaries 35, 39 shown in broken lines in FIG. 3 are no longer visible when the coil has been completed. Winding is done continuously, i.e. the wire extends without interruption from one section to the next.

As already explained with reference to FIG. 2 the apertures 23 and 25 have approximately the shape of a polygon. One side of said polygon coincides with the last turn of the section preceding the aperture in question and the other sides coincide with the first turn of the section succeeding the aperture. The path of the last turn of a section is determined by the location of the preceding turns of said section and this path will generally not be strictly rectilinear but slightly curved. The corners of the polygon determined by the pins 37, 41 are also slightly rounded off. This explains why the apertures have the shape of a polygon only to an approximation.

The number of pins per aperture and the place of said pins determine the shape of the apertures which together with the number of turns in each section is decisive in the distribution of the magnetic flux generated by the active portions 21. In the example described, for forming the apertures 23, pins 37, 38 are provided in the winding space on each side of the plane of symmetry 43 of the coil 9 in two places as a result of which said apertures have approximately the shape of a quadrangle. Said quadrangle has a largest width x, see FIG. 2, which is determined by the place of the pins 37. The part of the aperture 23 which has this largest width x is preferably present in the flared part of the coil 9, i.e. the central area of one of the active portions 21. The place of the other pin 38 is chosen near the front side of the coil to be wound so that one of the sides of the polygon is in the transition area between the active portion 21 in question and the front end portion 17 of the coil. It has been found that this shape and location of the apertures 23 is extremely suitable to produce a desired distribution of the generated magnetic flux. In particular it proves possible in this manner to generate a magnetic field which has a strong ten-pole component without other field components (for example the six-pole component) also becoming strong.

When magnetic fields having different properties are to be generated, the apertures 23, 25 may of course also have other shapes and/or be situated in different places. The number of apertures may also differ from the number given in the example. The coil described with reference to FIGS. 2 and 3 is symmetrical with respect to the plane 43, which means that the apertures 23, 25, situated on the left and on the right of said plane are replicas of each other and that the number of turns in the parts of each section situated on each side of said plane is equal. If desired it is also possible to provide assymmetries in the shape, location and number of the apertures and/or in the number of turns in the parts of the sections present on the left and on the right of the plane of symmetry 43.

What is claimed is:

1. A method of continuously winding saddle-shaped flared deflection coils (9) for picture display tubes, said coils being wider at their front side than at their rear side, in which the turns of the coil are distributed over a number of sections and in which each turn of a section surrounds the turns of the preceding sections and each pair of adjacent sections is separated over a part of its length by at least one aperture which is formed in that in at least one previously determined place along the boundary between the two sections after providing the number of turns desired for the first of the said two sections a pin extending approximately at right angles to the plane of the turns is provided in the winding space, after which the second section is wound around said pin, characterized in that for the formation of at least one of the apertures pins are provided substantially simultaneously into the winding space in at least two places on the same side of the plane of symmetry of the coil.

2. A method as claimed in claim 1, characterized in that at least one of the places where a pin is provided in the winding space to form the said aperture is present in the part of the winding space where the flared portion of the coil is formed.

3. A method as claimed in claim 2, characterized in that a second pin for the formation of the said aperture is provided in the winding space in a place near the front side of the coil to be wound.

4. A deflection system for a picture display tube comprising at least two saddle-shaped flared deflection coils each having a comparatively narrow rear and a comparatively wide front end portion between which two active portions extend on each side of a window in each of which at least one aperture is present, characterized in that at least one of the apertures has at least four sides.

5. A deflection system as claimed in claim 4, characterized in that the part of the said aperture which has the largest width (x) is situated in the flared part of the coil.

6. A deflection system as claimed in claim 4 or 5, characterized in that at least one of the sides of the said aperture is situated in the transition area between one of the active portions and the front end portion of the coil.

* * * * *